US007556176B2

(12) United States Patent
Yao

(10) Patent No.: US 7,556,176 B2
(45) Date of Patent: Jul. 7, 2009

(54) VENDING MACHINE WITH ADJUSTABLE MERCHANDISE RECEIVING HOLES

(76) Inventor: Shen-Hao Yao, 235 Chung-Ho Box 8-24, Taipei (TW)

( * ) Notice: Subject to any disclaimer, the term of this patent is extended or adjusted under 35 U.S.C. 154(b) by 0 days.

(21) Appl. No.: 11/840,225

(22) Filed: Aug. 17, 2007

(65) Prior Publication Data

US 2009/0045212 A1 Feb. 19, 2009

(51) Int. Cl.

| | |
|---|---|
| ***B65H 3/00*** | (2006.01) |
| ***B07F 11/00*** | (2006.01) |
| ***A24F 15/04*** | (2006.01) |
| ***B65H 3/60*** | (2006.01) |

(52) U.S. Cl. ..... 221/265; 221/263; 221/24; 221/264; 221/203; 221/35; 221/65; 221/195; 221/155; 221/196

(58) Field of Classification Search ..... 221/161, 221/265, 171, 24, 263, 264, 203, 35, 65, 221/155, 196, 195

See application file for complete search history.

(56) References Cited

U.S. PATENT DOCUMENTS

| | | | | |
|---|---|---|---|---|
| 5,833,117 | A * | 11/1998 | Kovens et al. | 221/24 |
| 7,175,046 | B2 * | 2/2007 | Yao | 221/265 |
| 7,337,919 | B2 * | 3/2008 | Walsh et al. | 221/221 |
| 2005/0279760 | A1 * | 12/2005 | Yao | 221/265 |
| 2006/0124659 | A1 * | 6/2006 | Mosconi et al. | 221/161 |

* cited by examiner

*Primary Examiner*—Gene Crawford
*Assistant Examiner*—Rakesh Kumar

(57) ABSTRACT

A vending machine with adjustable merchandise receiving hole comprises a body; a tank and a rotary disk; a stop plate being installed between the tank and the rotary disk; the stop plate having a notch corresponding to and above the output hole of the tank; a lifting unit being formed by a base and a lifting seat; the base being locked to a bottom of the tank; the base being installed with a buckle; a spring being installed between the buckle and the base; the lifting seat having at least one supporting rod; the supporting rod being formed with a recess for buckling with the buckle; an upper end of the supporting rod extending into the tank to be pivoted to a bottom of the stop plate; at least one reduced hole seat capable of being installed upon the receiving hole of the rotary disk.

1 Claim, 7 Drawing Sheets

VENDING MACHINE WITH ADJUSTABLE MERCHANDISE RECEIVING HOLES

FIELD OF THE INVENTION

The present invention relates to vending machines, and particularly to a vending machine with adjustable merchandise receiving holes, wherein the elevation and size of a receiving hole of a rotary disk of the vending machine are adjustable for suiting the size of the merchandise. Thus the manufacturing cost of the vending machine is reduced.

BACKGROUND OF THE INVENTION

With reference to FIGS. 1 to 3, the prior art vending machine is illustrated. In the prior art vending machine, the merchandises are packaged by a casing so as to suit the sizes of the merchandises to be sold.

Referring to FIG. 1, the prior art vending machine has the following elements.

A body 10 is included.

A tank 20 in the body 10 (referring to FIGS. 2 and 3) has an output hole 21 at a bottom thereof for outputting a merchandise 40. A lower end of the output hole 21 is connected to a transfer tube 11 to an output opening 12 at bottom of the body 10.

A rotary disk 30 (referring to FIGS. 2 and 3) has a plurality of merchandise receiving holes 31 for receiving merchandises 40. A rotary disk 30 is driven by a motor 32 so as to rotate in the tank 20.

By above mentioned structure, when the rotary disk 30 rotates, the merchandise 40 falling into the receiving hole 31 will be transferred to the output hole 21 of the tank 20. Then the merchandise 40 is transferred along the transfer tube 11 to the output opening 12 of the body 10.

Although the prior art vending machine has the advantage of vending merchandises automatically. However, the size of the receiving hole 31 is fixed, while the kinds of the merchandises 40 are not uniform so that various rotary disks 40 with different sizes of receiving holes 31 are made for matching the sizes of the merchandises 40, but this makes the cost increased.

SUMMARY OF THE INVENTION

Accordingly, the primary object of the present invention is to provide a vending machine with adjustable merchandise receiving hole, wherein the elevation of a receiving hole of a rotary disk of the vending machine and the size of the receiving hole are adjustable for suiting the size of the merchandise. Thus the manufacturing cost the vending machine is reduced.

To achieve above objects, the present invention provides a vending machine with adjustable merchandise receiving hole, comprising: a body; a tank in the body having an output hole at a bottom thereof for outputting a merchandise; a lower end of the output hole connected to a transfer tube to an output opening at bottom of the body; a rotary disk having a plurality of merchandise receiving holes for receiving merchandises; a rotary disk being driven by a motor so as to rotate in the tank; a stop plate being installed between the tank and the rotary disk; the stop plate having a notch corresponding to and above the output hole of the tank; a lifting unit being formed by a base and a lifting seat; the base being locked to a bottom of the tank; the base being installed with a buckle; a spring being installed between the buckle and the base; the lifting seat having at least one supporting rod; the supporting rod being installed with a recess for buckling with the buckle; an upper end of the supporting rod extending into the tank to be pivoted to a bottom of the stop plate; at least one reduced hole seat capable of being installed upon the receiving hole of the rotary disk; the reduced hole seat having a small merchandise receiving hole. By above mentioned structure, the size of the receiving hole of the rotary disk is adjustable by placing the reduced hole seat upon the receiving hole of the rotary disk and adjusting a height of the lifting seat of the lifting unit.

The various objects and advantages of the present invention will be more readily understood from the following detailed description when read in conjunction with the appended drawing.

DETAILED DESCRIPTION OF THE INVENTION

In order that those skilled in the art can further understand the present invention, a description will be provided in the following in details. However, these descriptions and the appended drawings are only used to cause those skilled in the art to understand the objects, features, and characteristics of the present invention, but not to be used to confine the scope and spirit of the present invention defined in the appended claims.

Referring to FIGS. 4 to 8, the structure of the present invention is illustrated.

Figure 1:
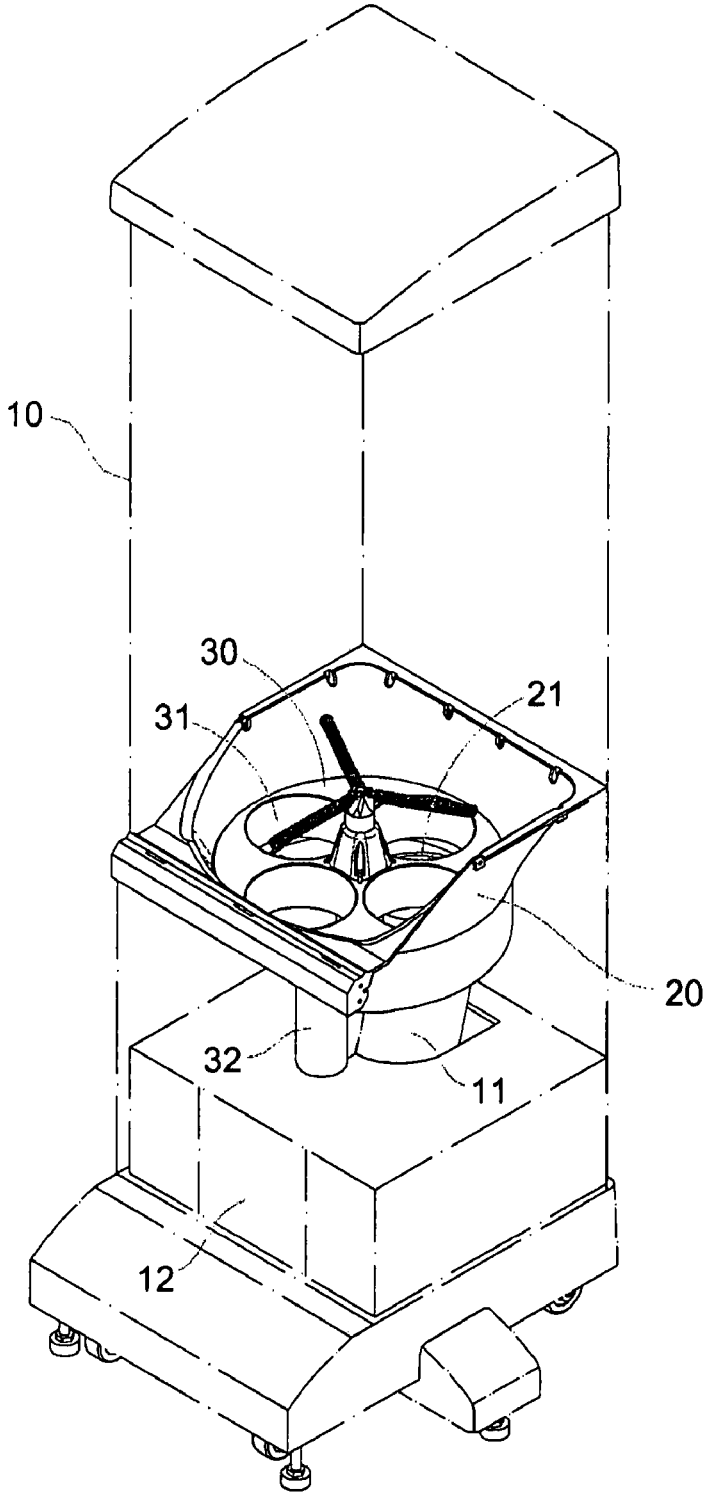
FIG. 1 is an assembled perspective view of a prior art vending machine.
Figure 2:
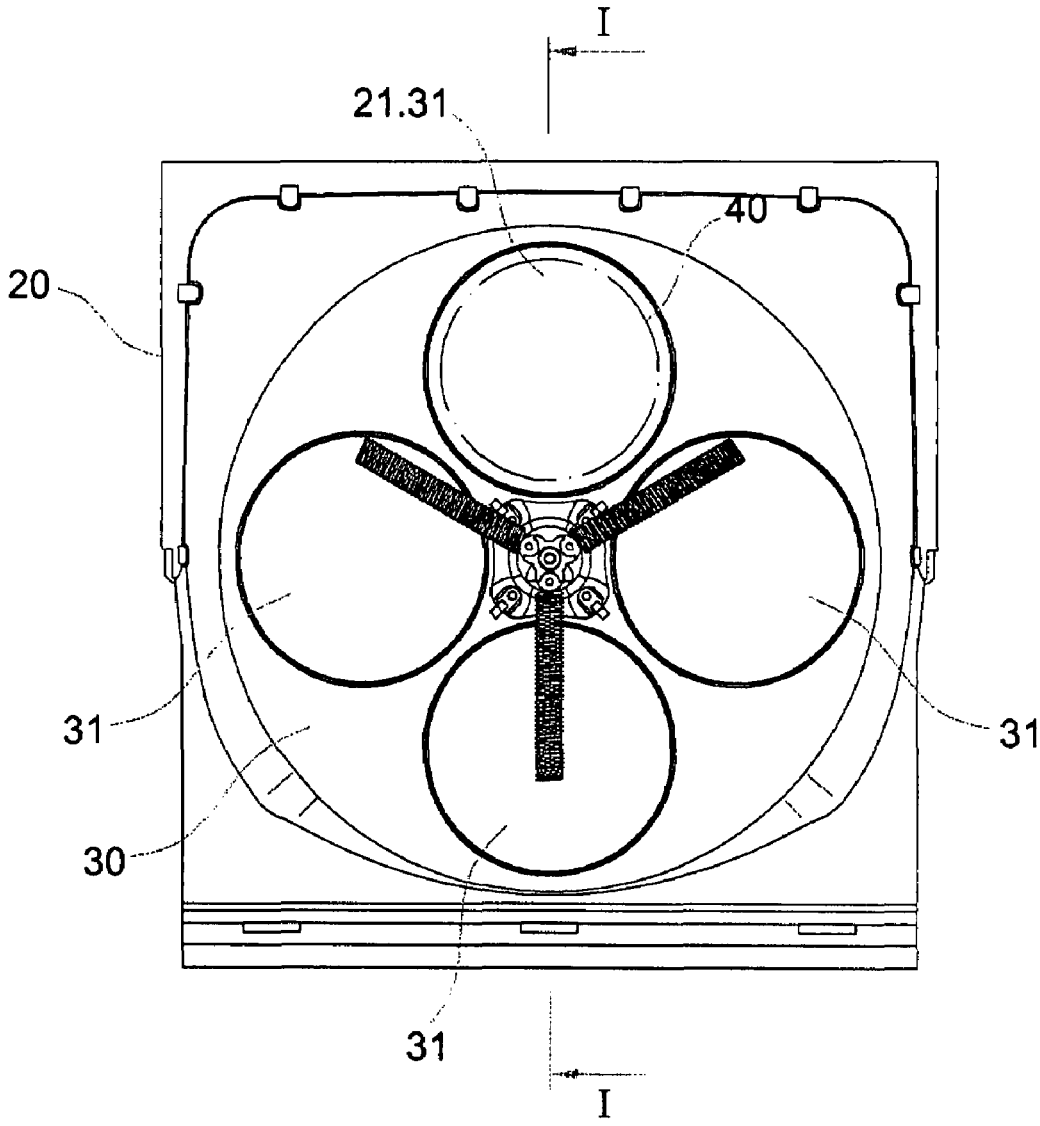
FIG. 2 is an elevation view of the prior art vending machine.
Figure 3:
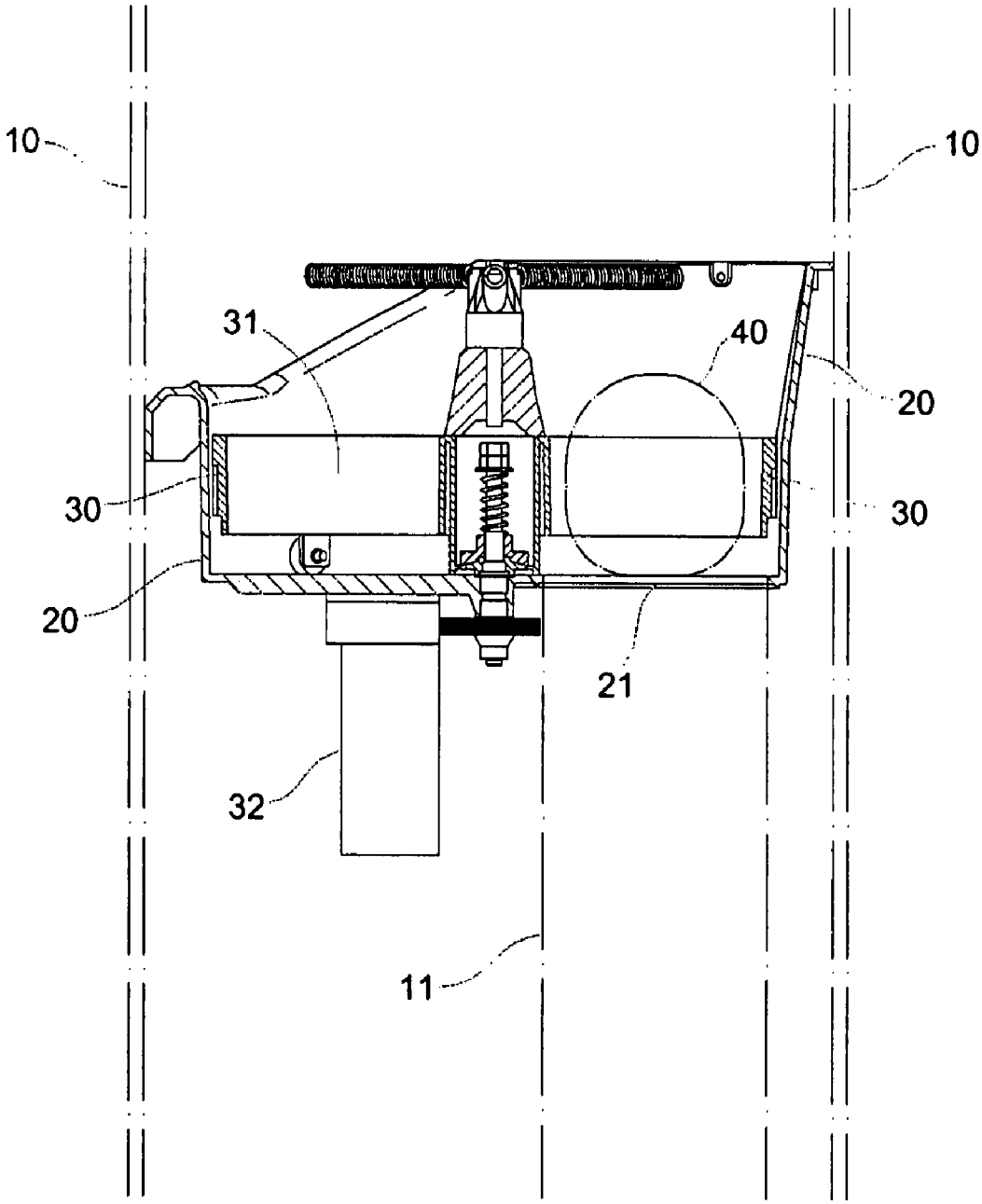
FIG. 3 is a cross sectional view along line I-I of the prior art vending machine.
Figure 4:
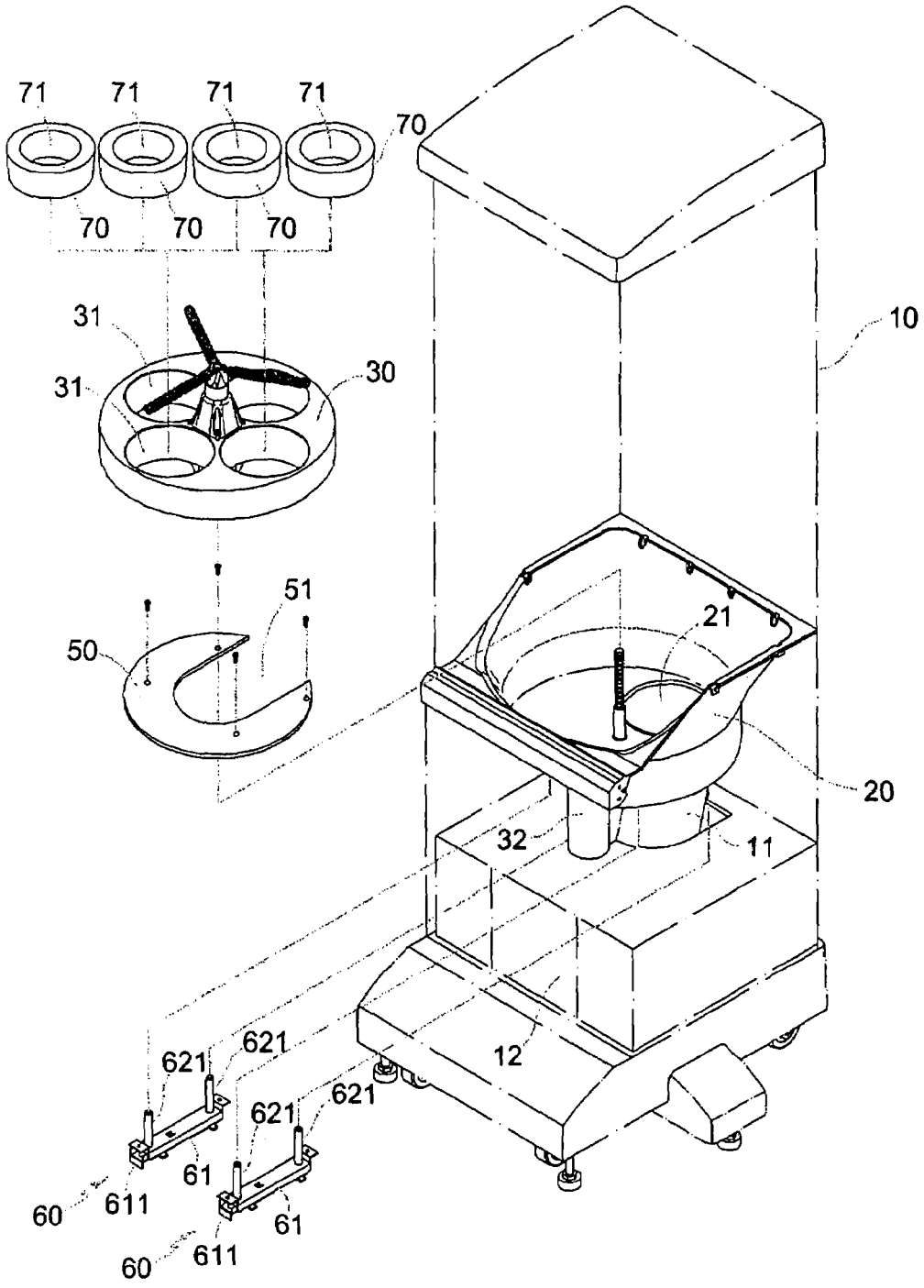
FIG. 4 is an exploded perspective view of the present invention.
Figure 5:
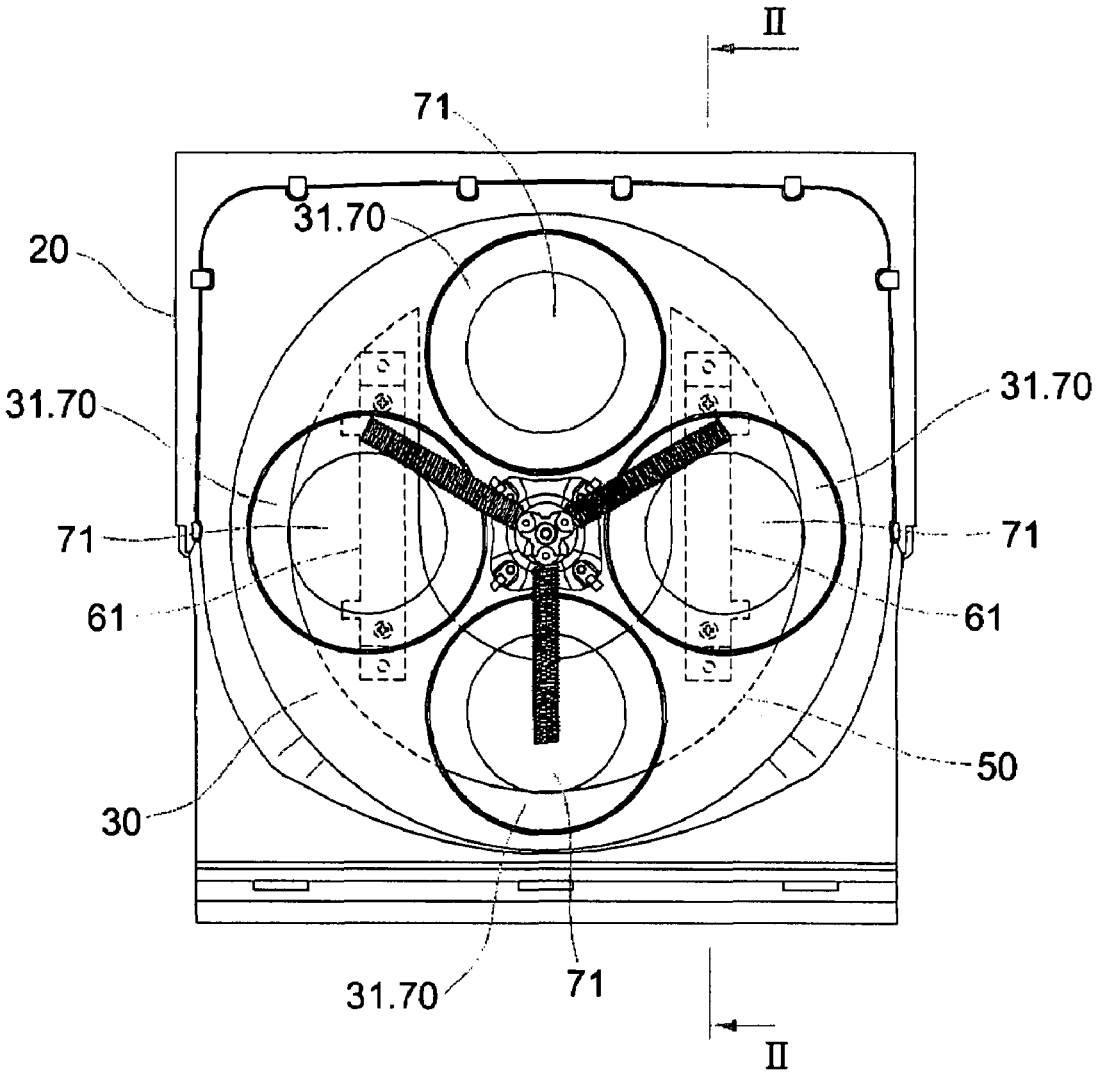
FIG. 5 is an elevation view of the present invention.
Figure 6:
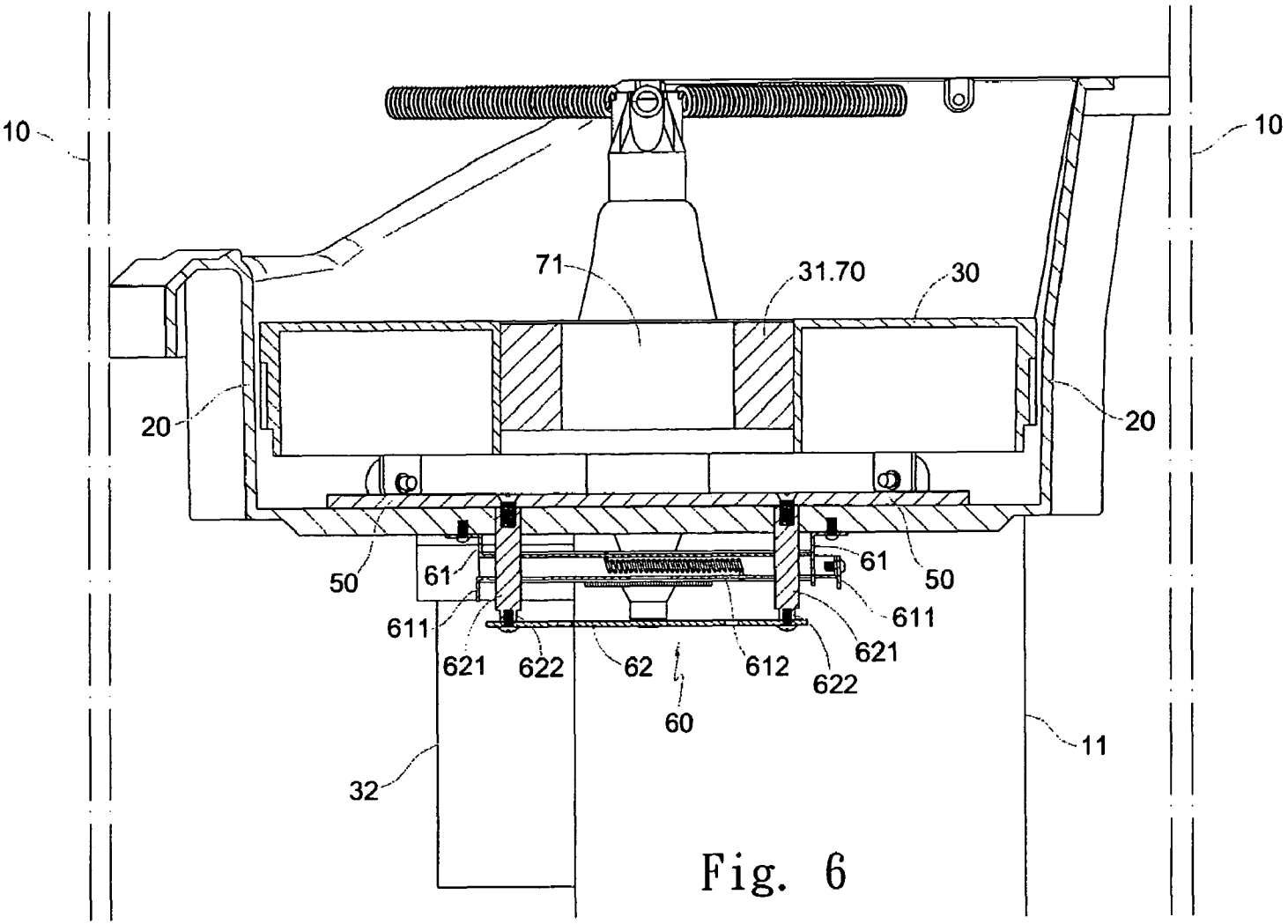
FIG. 6 is a cross sectional view along line II-II of the present invention.
Figure 7:
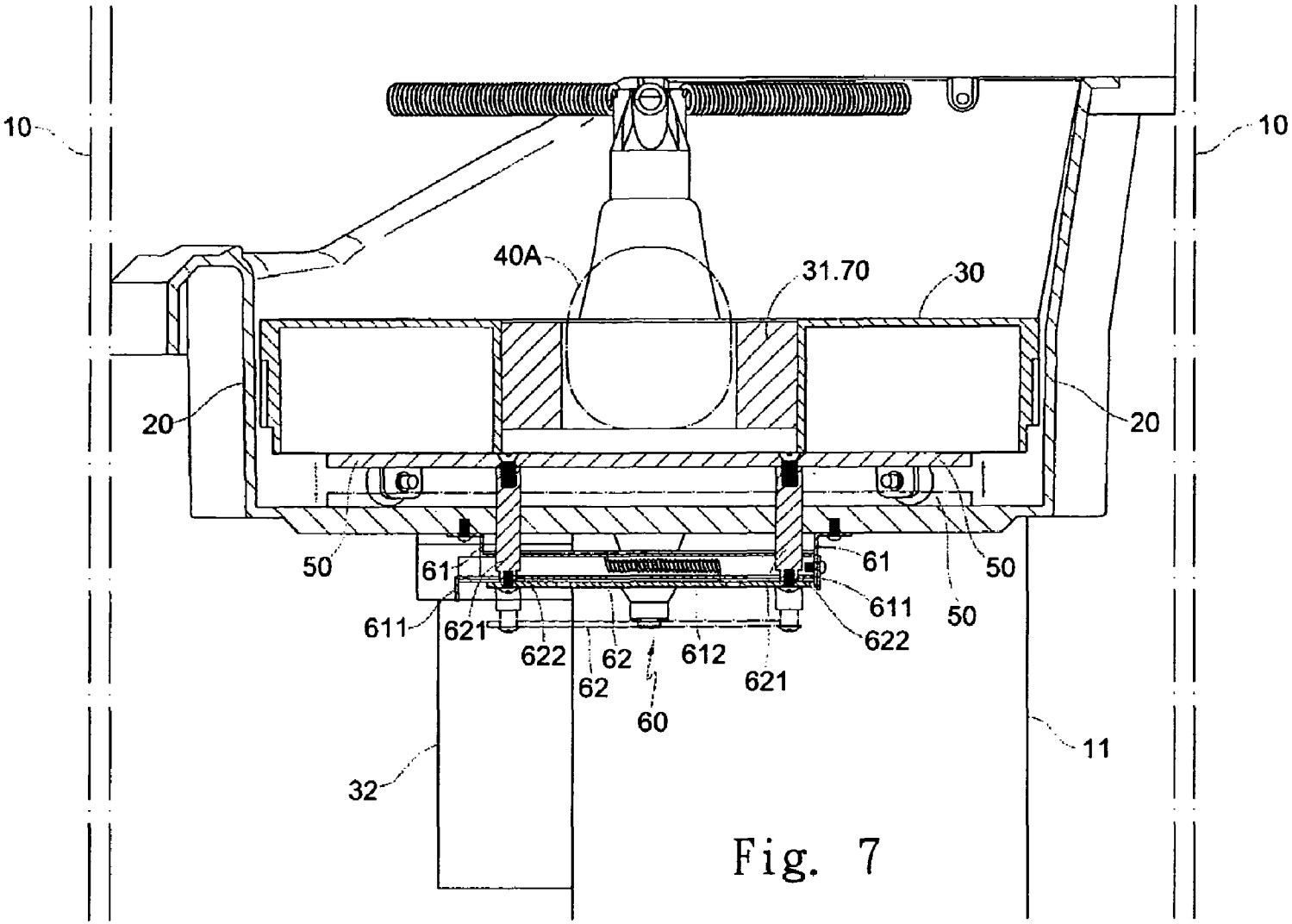
FIG. 7 is a schematic view showing the operation of the present invention.

With reference to FIG. 4, the merchandise output device for a vending machine according to the present invention is illustrated. The present invention has the following elements.

A body 10 is included.

A tank 20 in the body 10 (referring to FIGS. 5 and 6) has an output hole 21 at a bottom thereof for outputting a merchandise 40. A lower end of the output hole 21 is connected to a transfer tube 11 having an output opening 12 at bottom of the body 10.

A rotary disk 30 (referring to FIGS. 5 and 6) has a plurality of merchandise receiving holes 31 for receiving merchandises 40. A rotary disk 30 is driven by a motor 32 so as to rotate in the tank 20.

However, above mentioned structure is known in the prior art. Thus the details will not be further described herein. The difference of the present invention from the prior art will be described herein.

A stop plate 50 (referring to FIGS. 5 and 6) is installed between the tank 20 and the rotary disk 30. The stop plate 50 has a notch 51 corresponding to and above the output hole 21 of the tank 20.

A lifting unit 60 (referring to FIGS. 6 and 7) is formed by a base 61 and a lifting seat 62. The base 61 is locked to a bottom of the tank 20. The base 61 is installed with a buckle 611. A spring 612 is installed between the buckle 611 and the base 61. The lifting seat 62 has at least one supporting rod 621. The supporting rod 621 is formed with a recess 622 for buckling with the buckle 611. An upper end of the supporting rod 621 extends into the tank 20 to be pivoted to a bottom of the stop plate 50.

At least one reduced hole seat 70 (referring to FIGS. 5, 6, and 7) can be installed upon the receiving hole 31 of the rotary disk 30. The reduced hole seat 70 has a small merchandise receiving hole 71.

By above mentioned structure, when the small size merchandise 40A is to be sold. A reduced hole seat 70 suitable for the size of the merchandise 40A is placed upon the receiving hole 31 of the rotary disk 30 (referring to FIGS. 5 and 6) so as to change the size of the receiving hole 31. Then the height of the lifting seat 62 of the lifting unit 60 is adjusted (referring to FIG. 7). By using the stop plate 50 to change the distance between the rotary disk 30 and the tank 20, then the height of the lifting seat 62 is fixed by the buckle 611 to buckle the recess 622 of the supporting rod 621. Therefore, the elevation of the receiving hole 31 of the rotary disk 30 and the size of the receiving hole 31 are adjustable for suiting the size of the merchandise 40. Thus the manufacturing cost the vending machine is reduced.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A vending machine with adjustable merchandise receiving holes, comprising:

a body;

a tank in the body having an output hole at a bottom thereof for outputting a merchandise; a lower end of the output hole connected to a transfer tube having an output opening at bottom of the body;

a rotary disk (30) having a plurality of merchandise receiving holes for receiving merchandises; a rotary disk being driven by a motor so as to rotate in the tank;

a stop plate (50) being installed between the tank and the rotary disk; the stop plate having a notch (51) corresponding to and above the output hole of the tank; and one end of the notch (51) being open from one edge of the stop plate (50);

a lifting unit being formed by a base (61) and a lifting seat (62); the base being locked to a bottom of the tank; the base being installed with a buckle (611); a spring (612) being installed between the buckle and the base; the lifting seat having two supporting rods (621) installed at two ends thereof; each supporting rod being formed with a recess (622) for buckling with the buckle; an upper end of the supporting rod extending into the tank to be pivoted to a bottom of the stop plate; each supporting rod (621) is a straight rod and is installed to be approximately vertical to the lifting seat (62);

at least one reduced hole seat (70) capable of being installed upon the receiving hole of the rotary disk (30); the reduced hole seat having a small merchandise receiving hole; and wherein by above mentioned structure, the size of the receiving hole of the rotary disk is adjustable by placing the reduced hole seat upon the receiving hole of the rotary disk and adjusting a height of the lifting seat of the lifting unit.

* * * * *